US006344619B1

(12) United States Patent
Yamasaki et al.

(10) Patent No.: US 6,344,619 B1
(45) Date of Patent: Feb. 5, 2002

(54) MULTI-DIRECTIONAL OPERATING SWITCH AND MULTI-DIRECTIONAL OPERATING DEVICE USING THE SAME

(75) Inventors: Masato Yamasaki; Jun Sato, both of Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/617,220

(22) Filed: Jul. 17, 2000

(30) Foreign Application Priority Data

Jul. 16, 1999 (JP) ..... 11-203075

(51) Int. Cl.[7] ..... H01H 25/06
(52) U.S. Cl. ..... 200/6 A
(58) Field of Search ..... 200/4, 5 R, 6 A, 200/17 R, 18, 335, 339; 345/157, 161; 463/36–38

(56) References Cited

U.S. PATENT DOCUMENTS 2,808,476 A * 10/1957 Elliott ..... 200/6 A
4,428,649 A * 1/1984 Main et al. ..... 350/289
4,501,939 A * 2/1985 Hyltin et al. ..... 200/6 A
4,896,003 A 1/1990 Hsieh ..... 200/6 A
5,298,706 A 3/1994 English et al. ..... 200/517
5,496,977 A 3/1996 Date et al. ..... 200/6 A
5,498,843 A 3/1996 Date et al. ..... 200/6 A
5,889,242 A 3/1999 Ishihara et al. ..... 200/6 A
6,124,555 A * 9/2000 Isikawa ..... 200/4
6,160,225 A * 12/2000 Isikawa ..... 200/4

* cited by examiner

*Primary Examiner*—Michael Friedhofer
(74) *Attorney, Agent, or Firm*—Ratner & Prestia

(57) ABSTRACT

A multi-directional operating switch comprises: a case made of resin having generally a square opening on top, provided on a bottom surface thereof with a central contact, an outer contact, and peripheral contacts disposed at each corner of the opening; a dome-like circular movable contact disposed within the opening in a manner to rest in contact with the outer contact; a manipulation body having a flange and a contact plate under the flange, placed above the dome-like circular movable contact; and a cover for covering the opening and having a shaft of the manipulation body penetrating therethrough. Switching operation is made between the central contact and the outer contact when the shaft is depressed, and between any adjacent pair of the peripheral contacts, as the dome-like circular movable contact is being deformed, when the shaft is tilted.

21 Claims, 16 Drawing Sheets

MULTI-DIRECTIONAL OPERATING SWITCH AND MULTI-DIRECTIONAL OPERATING DEVICE USING THE SAME

FIELD OF THE INVENTION

The present invention relates to a multi-directional operating switch activated by a tilting manipulation as well as a pushing manipulation of a manipulating shaft, used mainly in an input controller or the like of a mobile communications device such as a portable telephone, a radio pager, etc., as well as various electronic devices such as remote controllers, audio equipment, game machines, car navigation systems, electronic cameras, and the like. The invention also relates to a multi-directional operating device using the same.

BACKGROUND OF THE INVENTION

A conventional multi-directional operating switch will be described hereinafter by referring to FIG. 13 through FIG. 16.

In FIG. 13 depicting a sectioned front view, a box-like case 1, made of plastic resin, has an opening in an upper surface covered by a cover 2 made of a metal plate, or the like.

A bottom surface of the case 1 is provided with a central contact 3A, an outer contact 3B, and four peripheral contacts 4, 5, 6 and 7 disposed in positions equidistant from the central contact 3A toward directions of right, left, back and front, all fixed by an insert molding. These contacts are connected individually to their respective terminals 14A, 14B, and 15, 16, 17 and 18. A dome-like circular movable contact 8 is placed over the outer contact 3B. A common movable contact 9 is fixed by dowels 1A above the peripheral contacts 4, 5, 6 and 7 in such a manner that flexible contact leaves 10, 11, 12 and 13 of the common movable contact 9 face their respective peripheral contacts 4, 5, 6 and 7. The common movable contact 9 is connected to a terminal 19A for external connection via a contact 19 on the bottom surface of the case 1.

A supporting body 21 is positioned above the common movable contact 9, and a square-shaped upper end 21A of the supporting body 21 maintains a resilient contact with an underside surface of the cover 2, as it is biased upwardly by a compression coil spring 20 disposed beside an inner periphery along side walls of the case 1. A recessed portion 21B in the center of the supporting body 21 holds a semispherical rotary body 22.

The rotary body 22 is in a position where a flange portion 22A at its lower perimeter rests on a bottom surface of the recess portion 21B in the center of the supporting body 21, and an upper spherical portion 22B fits in contact with a spherical surface of a circular hole 2A in the center of the cover 2. A rod-like manipulating shaft 23 made of metal is inserted and held in a vertical center hole 22C having a noncircular shape in the rotary body 22 in a vertically slidable manner.

The manipulating shaft 23 has a lower end 23A projecting downwardly from the rotary body 22, so as to rest in contact with the dome-like circular movable contact 8 in the center of the bottom surface of the case 1. A manipulation knob 24 is mounted on a tip end 23B of the manipulating shaft 23 projecting upwardly above the case 1.

A lower surface around an outer perimeter of the supporting body 21 is provided with depressing points 25A, 25B, 25C and 25D, corresponding respectively to the flexible contact leaves 10, 11, 12 and 13 of the common movable contact 9. Incidentally, the depressing points 25C and 25D corresponding to the flexible contact leaves 12 and 13 are not shown in FIG. 13, since it is a sectional view depicting only one side of the switch.

The multi-directional operating switch operates in a manner as described hereinafter. First, the manipulating shaft 23 is in its vertical neutral position, and all contacts of the multi-directional operating switch are in their OFF positions in a state of FIG. 13, wherein the lower end 23A of the manipulating shaft 23 does not depress the dome-like circular movable contact 8 at the center.

When a left upper surface of the manipulation knob 24, mounted on the tip end 23B at an upper part of the manipulating shaft 23, is depressed downward, as indicated by an arrow 100 in a sectioned front view of FIG. 15, the manipulating shaft 23 tilts and the rotary body 22 rotates toward the left side while maintaining a contact with the spherical surface of the circular hole 2A of the cover 2. This causes an edge of the flange portion 22A on the underside of the rotary body 22 to push the bottom surface of the recess portion 21B of the supporting body 21 downward. The supporting body 21 then tilts left around a fulcrum at one side of the square-shaped upper edge 21A opposite to the surface being pushed, and thereby the flexible contact leaf 10 corresponding to the depressed point 25A is pushed downward to come in contact with the peripheral contact 4. This establishes electrical continuity between the common movable contact 9 and the peripheral contact 4, and completes a state of continuity between the terminals 19A and 15 for external connections. During this movement, a left side of the upper edge 21A in the perimeter of the supporting body 21 separates from the underside surface of the cover 2, while depressing the compression coil spring 20 downward.

When the depressing force applied to the manipulation knob 24 is subsequently removed, the restoring force of the compression coil spring 20 pushes the supporting body 21 and the rotary body 22 back to their original neutral positions shown in FIG. 13. At the same time, the resilient restoring force also returns the flexible contact leaf 10 to the original position shown in FIG. 13 by separating it from the peripheral contact 4, thereby returning the switch contact to the OFF state.

Likewise, electrical continuity can be established between any of the terminals 16, 17 and 18 and the terminal 19A for external connections, by changing a position to be depressed between the right side, near side and a back side, respectively, on the upper surface of the operating knob 24 mounted on the manipulating shaft 23.

When a upper center surface of the operating knob 24, i.e. the manipulating shaft 23, is pushed downwardly by placing a vertical depressing force from above, as shown by arrow 200 (indicated in a sectioned front view of FIG. 16), the lower end 23A pushes the dome-like circular movable contact 8 on the bottom surface of the case 1, causing it to deform. This makes the dome-like circular movable contact 8 on the bottom surface produce a tactile response, and establish a state of continuity between the terminals 14A and 14B by establishing electrical continuity between the central contact 3A and the outer contact 3B. The manipulating shaft 23 is pushed up by the restoring force of the dome-like circular movable contact 8, and returned to its original position shown in FIG. 13, when the depressing force is removed.

In spite of a growing demand for downsizing of a variety of the latest electronic apparatuses, it has been difficult to realize a reduction in the overall dimension and thickness of the above described conventional multi-directional operating switch. In addition, the cost has been too high due to the large number of constituent components. The conventional switch also has had a problem in that it is difficult for an operator to sensory determine when a switch contact turns on, since the switch does not produce a positive tactile response when switching is made by tilting the manipulating shaft.

The present invention is intended to overcome the above problems of the prior art device, and aims at providing a multi-directional operating switch, which is small, thin and uses a small number of components, yet it is capable of making a reliable switching operation with a tactile response even when the switching is made by tilting a manipulating shaft sideways. The invention also aims at providing a multi-directional operating device employing the multi-directional operating switch.

SUMMARY OF THE INVENTION

A multi-directional operating switch of the present invention includes: (a) a case having an opening in an upper surface, provided with a central contact, an outer contact disposed in a position spaced away from the central contact, and a plurality of peripheral contacts, all disposed on a bottom surface of it; (b) a dome-like circular movable contact having a center portion disposed above the central contact, and a lower peripheral rim resting in contact with the outer contact; (c) a cover provided with a through hole in a location concentric to the dome-like circular movable contact; and (d) a manipulation body including a shaft protruding the through hole in the cover, a flange having electrical conductivity on at least a lower surface of it, the flange disposed at a lower end of the shaft, and a projection extending from the lower surface of the flange, the manipulation body positioned in a manner that it is not rotatable, but the shaft is tiltable and vertically movable, and the manipulation body also being kept biased upwardly by the dome-like circular movable contact in a manner that at least an upper peripheral surface of the flange stays in contact with a lower surface of the cover, wherein the projection on the flange depresses and deforms the dome-like circular movable contact, which in turn establishes an electrical continuity between the central contact and the outer contact, when the shaft is subjected to a downward pushing manipulation, and the lower surface of the flange makes an electrical continuity between two adjacent peripheral contacts located at a side of tilting direction, when the shaft of the manipulation body is subjected to a tilting manipulation.

With the foregoing structure, the invention can thus realize the multi-directional operating switch that is small and thin in size, and exceedingly manipulatable with reliable switching capability, at low cost and having a small number of constituent components. The switch is also capable of producing a certain magnitude of tactile response with only a single dome-like circular movable contact disposed in the case, even when a switching operation is performed between adjacent pairs of the peripheral contacts by tilting the shaft of the manipulation body sideways, in addition to establishing electrical continuity between the central contact and the outer contact by pushing the shaft of the manipulation body vertically downward.

Further, a multi-directional operating switch of the present invention includes a case having an opening of generally a square shape, provided with a peripheral contact at each corner of the opening, in which a flange of a manipulation body formed into a shape generally similar to the opening is housed. This structure can easily prevent the flange of the manipulation body from turning within the case when the manipulation body is manipulated, and maintain proper positions of both components with respect to each other at all times. Consequently, the manipulating shaft can be tilted and held reliably in a direction intermediate between any adjacent pair of the peripheral contacts disposed at each corner in the case, since the generally square-shaped flange stays stationary with one of its lower sides resting on a bottom surface of the case when the manipulation body is tilted. In addition, the structure makes it easy to set an equal tilting angle of the shaft of the manipulation body at all tilting directions, at which any adjacent pair of the peripheral contacts come into an ON state. Therefore, the invention provides an advantage of realizing a multi-directional operating switch, which is small in overall dimensions with a simple structure, yet capable of making switching operations with an equal angle of tilting manipulation toward all four directions that are frequently used.

In another aspect of this invention, a multi-directional operating switch is constructed so that both an opening in a case and a flange of a manipulation body have a generally rectangle shape. This structure realizes a multi-directional operating switch that can differentiate tilting angles of a shaft of the manipulation body, at which any adjacent pair of peripheral contacts come into an ON state, between two tilting directions intersecting with each other, by varying a proportion in length between a longitudinal side and a lateral side of the rectangular opening and the flange.

In yet another aspect of the invention, a multi-directional operating switch includes a case having an opening having a generally pentagonal, hexagonal, or octagonal shape, provided with a peripheral contact at each corner of the opening. The opening houses a flange of a manipulation body, formed into a shape generally similar to that of the opening. This structure is able to readily provide the multi-directional operating switch wherein the flange of the manipulation body is restricted from turning within the case, and the manipulation body is tiltable toward a desired number of directions by adopting the polygonal shape having the desired number of sides.

In still another aspect of the invention, a multi-directional operating switch includes a case having a circular shaped opening, provided with peripheral contacts disposed at an equal distance and an equal angle with respect to the center of the opening. The opening houses a flange of a manipulation body, formed into a circular shape with a diameter slightly smaller than that of the opening. In addition, the switch is provided with a turn restricting means at a portion where a shaft of the manipulation body engages with a through hole in a cover, in order to maintain a relative position of the flange of the manipulation body with respect to the peripheral contacts in the case. This multi-directional operating switch can be manipulated in a manner that a top end of the shaft of the manipulation body moves circularly while the shaft is kept tilted, since the manipulation body has the circular-shaped flange. Thereby, making it capable of switching a plurality of the peripheral contacts disposed in the circular opening smoothly in a consecutive manner.

Furthermore, a multi-directional operating switch of this invention is provided with a cover having a through hole in a shape other than a circle, and a manipulation body having a shaft also in a shape other than a circle in crosssection, for insertion into the through hole, to serve as a turn restricting means for the manipulation body provided with a circular flange. This structure, despite its simple construction, can reliably prevent the manipulation body from turning within a case.

In a multi-directional operating switch of the present invention having the above-described structure, at least a projection provided on a lower surface of a flange of a manipulation body is constructed of an insulation material. This projection can positively isolate a group of switching circuits through peripheral contacts from another group of switching circuits connected through a central contact and an outer contact via a dome-like circular movable contact.

In another aspect of this invention, a multi-directional operating switch includes a cover made of a rigid insulation material, a manipulation body having a shaft and a projection molded integrally on a lower end of a flange with a rigid insulation material, and an electrically conductive plate-like contact plate secured to the manipulation body. This multi-directional operating switch is capable of obstructing external electrostatic noises and the like from entering into a switching circuit, because the structure protecting the switch contacts a space with the insulative cover. The structure can also provide a product of thin configuration, since it reduces a thickness of the flange secured to the manipulation body.

In still another aspect of this invention, a multi-directional operating switch includes a cover made of a rigid insulation material, a manipulation body having a shaft and a flange composed integrally with an electrically conductive material, and a projection made of an insulation material attached to a lower surface in the center of the flange. Since the shaft and the flange of the manipulation body are integrally composed, they move solidly and positively to create reliable switching with individual contacts, without wobbling, when the manipulation body is subjected to a predetermined manipulatory movement. In addition, the above structure facilitates adjustment of a magnitude of tactile response during a manipulation, if necessary, by selecting a shape and a size of the projection to be attached.

In still another aspect of the invention, a multi-directional operating switch is provided with a manipulation body including a flange made of an electrically conductive material having resiliency. When a shaft of this switch is tilted, an electrical continuity is established first between two adjacent peripheral contacts of a given side. Another electrical continuity is then established between a central contact and an outer contact, when a projection under the flange subsequently pushes a dome-like circular movable contact after the flange on the manipulation body deforms resiliently. This structure provides the multi-directional operating switch that allows a selection of either state of continuity or non-continuity between the central contact and the outer contact by way of varying a manipulatory force to tilt the shaft, after an electrical continuity is made between any adjacent pair of the peripheral contacts. In an electronic apparatus equipped with this multi-directional operating switch, for example, it is possible to use the switch in a such functional manner that a variety of items displayed on a display window and the like are scrolled, or moved, at a low speed, when only the peripheral contacts are turned on, and they are scrolled at a high speed, when the central contact and the outer contact are additionally turned on. Moreover, this structure of the switch can prevent damage to contact members such as the peripheral contacts, even if the shaft is tilted excessively due to an unintentional large force given to the manipulation body, since the flange is resilient.

As has been described, this multi-directional operating switch, when mounted in a variety of multi-directional operating devices, can achieve congregation and simplification of a variety of manipulations as well as downsizing, and reductions in thickness and weight at the same time.

DESCRIPTION OF THE PREFERRED EMBODIMENTS

Referring to FIG. 1 through FIG. 12, there is described hereinafter a multi-directional operating switch of preferred exemplary embodiments of the present invention, and a multi-directional operating device equipped with this switch.

First Exemplary Embodiment

Figure 1:
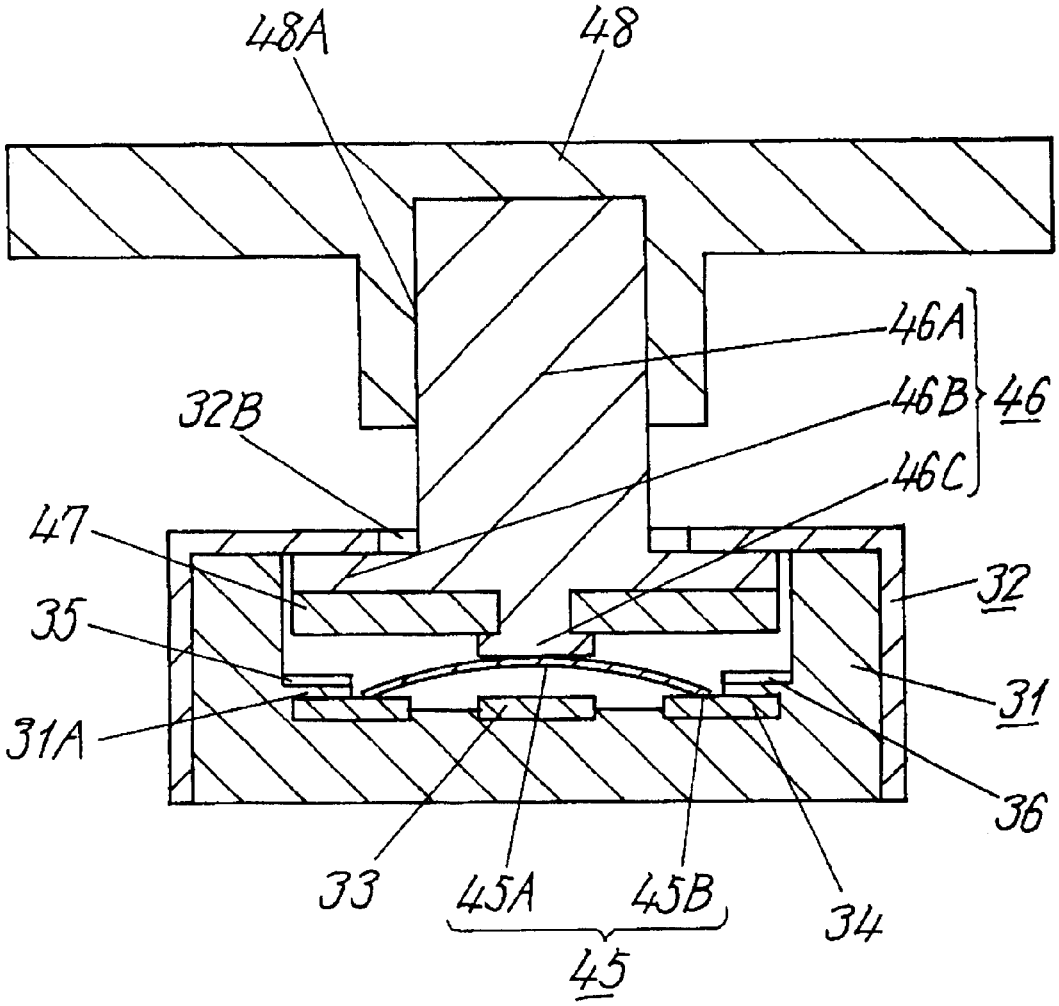
FIG. 1 is a sectional front view depicting a multi-directional operating switch of a first exemplary embodiment of the present invention.
Figure 2:
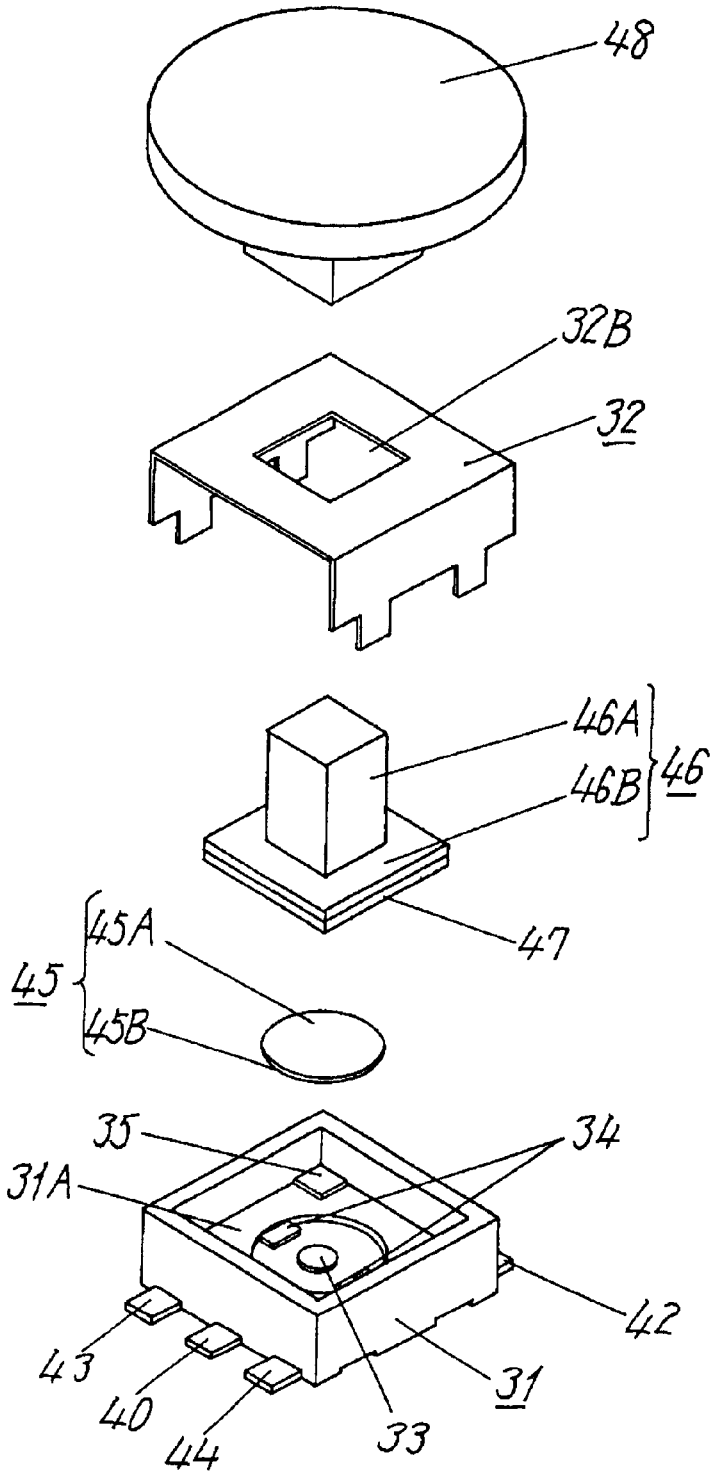
FIG. 2 is an exploded perspective view depicting the switch of FIG. 1.

FIG. 1 is a sectional front view depicting a multi directional-operating switch of a first exemplary embodiment of the present invention, and FIG. 2 is an exploded perspective view of the same. In FIG. 1 and FIG. 2, a box-like case 31 made of molded resin for example, is provided in its upper surface with an opening having a generally square shape as viewed from above. This opening is covered by a cover 32 made of a metal plate or the like in the same manner as that of the prior art switch.

Figure 3:
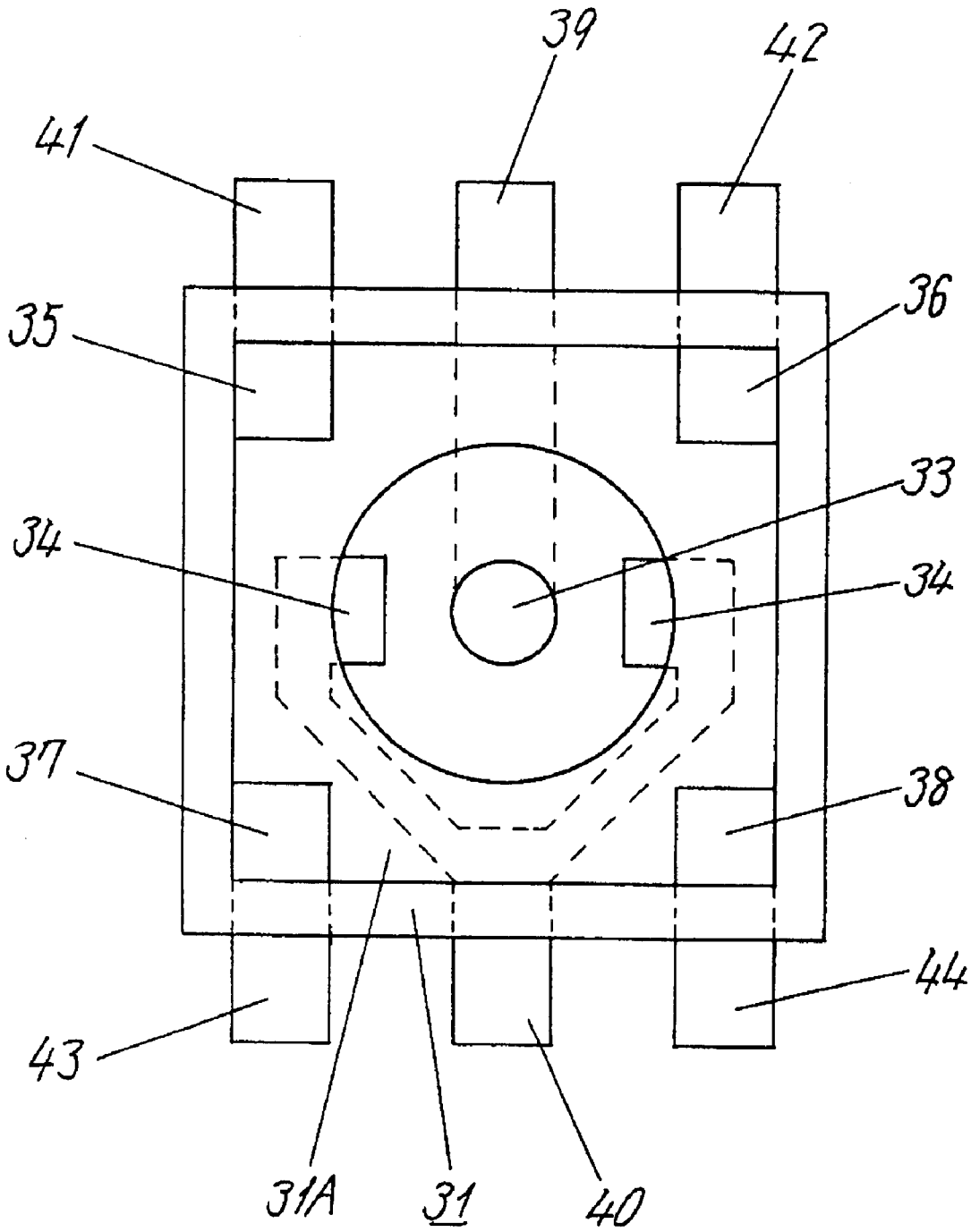
FIG. 3 is a plan view depicting a case of the switch of FIG. 1.

Provided on the inner bottom surface of case 31 is a central contact 33, and an outer contact 34 disposed in a position at a predetermined space apart from the central contact 33, as shown in the plan view of FIG. 3. There is provided a raised portion 31A of a predetermined height in an area outside of a circular space having a radius equal to a distance from the central contact 33 to the outer contact 34. In addition, there are four peripheral contacts 35, 36, 37 and 38, all fixed by the insert molding on the raised portion 31A at four corners of the opening. In other words, these peripheral contacts 35, 36, 37 and 38 are disposed in positions equally spaced from the central contact 33 toward its left, right, rear and front at equal angles. There are also terminals 39, 40, 41, 42, 43 and 44 for external connections, respectively corresponding to the central contact 33, the outer contact 34, and the peripheral contacts 35, 36, 37 and 38, protruding outwardly from the case 31.

A dome-like circular movable contact 45 made of a thin resilient sheet metal is disposed in such a manner that an underside surface of a top center portion 45A is above the central contact 33 positioned on the bottom surface of the case 31, and a lower peripheral rim 45B rests directly on and in contact with the outer contact 34 in the case 31.

A manipulation body 46 made of insulation resin, for example, includes a shaft 46A, a flange 46B having a generally square shape formed integrally at a lower end of the shaft, and a projection 46C for a depressing function. Projection 46C is provided coaxially with the shaft 46A in the center portion of a lower surface of the flange 46B. The projection 46C on the manipulation body 46 rests on and is supported by the top center portion 45A of the dome-like circular movable contact 45. The flange 46B is housed in the case 31 with the shaft 46A protruding upwardly from the central through hole 32B in the cover 32. That is, the opening of generally square shape in plan view of the case 31 houses the flange 46B of the manipulation body 46, formed into a generally square shape of a similar configuration. Thereby, the manipulation body 46 can maintain a proper position with respect to the case 31 without turning.

Figure 4:
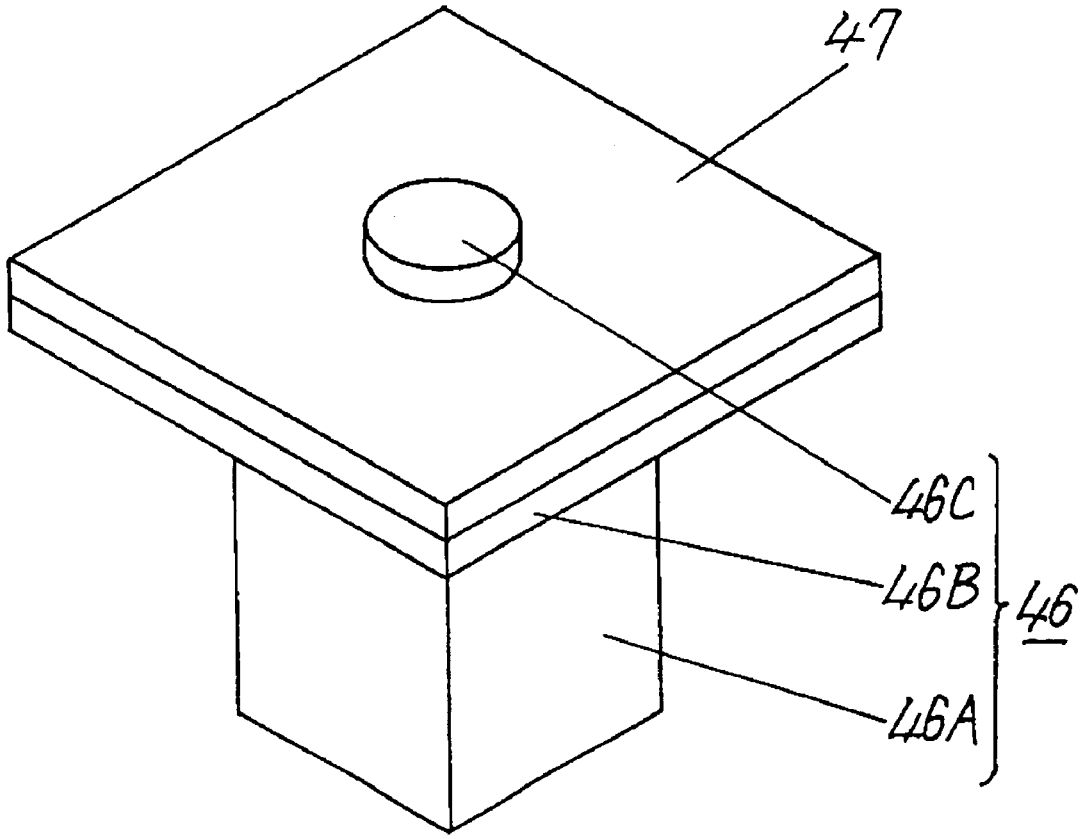
FIG. 4 is a perspective view depicting an underside of an exemplary manipulation body of the switch of FIG. 1.

FIG. 4 illustrates a perspective view of an underside of the manipulation body 46. As shown in FIG. 4, the manipulation body 46 has a metal contact plate 47, formed into generally a square shape of substantially the same size as the flange 46B, and fixed to a lower surface of the flange 46B by the outsert molding. This contact plate 47 provides the flange 46B electrical conductivity throughout its lower surface, except for the projection 46C provided in the center portion of the surface.

The manipulation body 46 is provided with a upward thrusting force by the dome-like circular movable contact 45 via the projection 46C on the lower surface at the center of the flange 46B. Under a normal state, in which a manipulating force is not placed on the shaft 46A, the thrusting force holds the flange 46B in direct contact with a lower surface of the cover 32, so as to keep the shaft 46A in its neutral position. The manipulation body 46, i.e. the shaft 46A, is thereby movable according to a vertical manipulation and a tilting manipulation in a predetermined way.

In addition, a manipulation knob 48 of a predetermined shape is attached to the manipulation body 46 by press-fitting a top end of the shaft 46A into a bottom hole 48A of the knob 48. An external configuration of the manipulation knob 48 can be of any shape such as circle, polygon, and the like.

An operation of the multi-directional operating switch of the present exemplary embodiment will be described next.

First, in the normal state shown in FIG. 1, wherein a manipulatory force is not applied to the shaft 46A of the manipulation body 46, all of the contacts of this switch remain in their open state, i.e. OFF position, since the shaft 46A stays in the upright neutral position.

Figure 5:
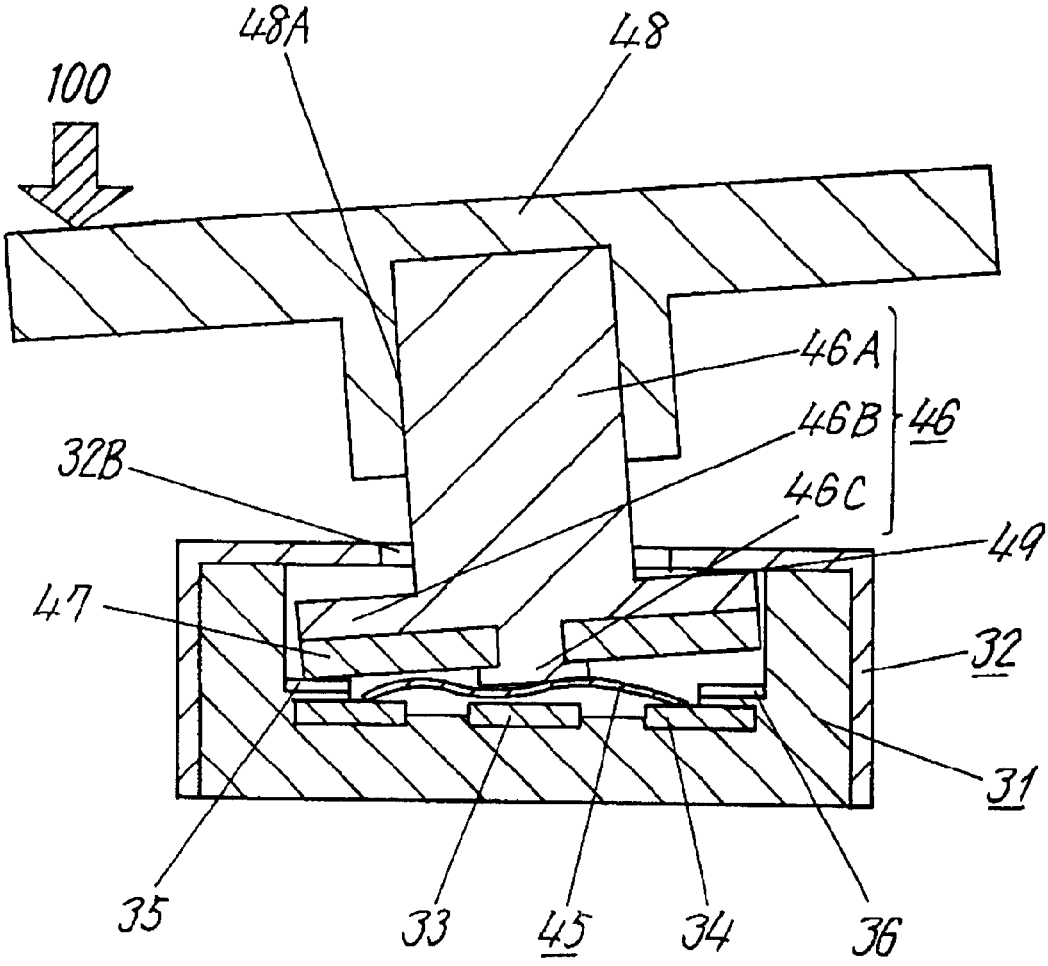
FIG. 5 is a sectional front view depicting the switch of FIG. 1 with the manipulation body in a tilted position.

The description hereinafter pertains to an operation, when a depressing force is placed on the manipulation knob 48 in a manner to push it downward at a point between any adjacent pair of the peripheral contacts disposed on the bottom surface of the case 31, between the contacts 35 and 37 for instance, as shown by an arrow 100 in a sectional front view of FIG. 5. The depressing force makes the manipulation body 46 tilt about a fulcrum at an upper edge 49 of the flange 46B, at a side opposite the position where the depressing force is placed. This causes the projection 46C on the lower surface of the manipulation body 46 to depress and deform the dome-like circular movable contact 45 downward, thereby providing a tactile response. At the same time, it also causes the conductive plate 47 on the lower surface of the flange 46B to contact the peripheral contacts 35 and 37 to make them electrically conductive. Accordingly, this establishes electrical continuity between the terminals 41 and 43 for external connections, as they are integrally formed with the peripheral contacts 35 and 37 respectively.

Since the flange 46B of the manipulation body 46 (formed into generally square shape) is housed in the opening, (also formed into a generally square shape in a size slightly larger than the flange 46B in plan view,) in the case 31, the manipulation body 46 is effectively prevented from turning. In the above embodiment, the peripheral contacts 35 and 37, i.e. two peripheral contacts adjacent to each other in general, conduct with one another resulting in electrical continuity.

When the depressing force placed on the manipulation knob 48 is subsequently removed, the dome-like circular movable contact 45 restores the original configuration by a resilient restoring force of its own, and pushes back the projection 46C on the lower surface of the flange 46B upward. The conductive plate 47 on the lower surface of the flange 46B separates from the peripheral contacts 35 and 37 to return these peripheral switch contacts into an open state, and the manipulation body 46 resumes a normal state, in which the shaft 46A is in the upright neutral position, as shown in FIG. 1.

When the manipulation knob 48 is depressed in the like manner at another position corresponding to a point between any adjacent pair of the peripheral contacts, the manipulation body 46 tilts toward that direction, thereby causing the corresponding peripheral switch contacts to conduct with one another resulting in electrical continuity. An electrical continuity can thus be established between two corresponding terminals for external connections, among combinations of 41-42, 42-44, 44-43, and 43-41.

A signal transmitted through thus established continuity between the peripheral switch contacts is read and examined by a microcomputer for example (not shown in the figure), serving as a switching recognition means, connected to the terminals 41, 42, 43 and 44 for external connections. As a result, the microcomputer is able to recognize that the shaft 46A is tilted toward a direction midway between the above-described adjacent pair of the peripheral switch contacts.

During a tilting manipulation of the manipulation knob 48, there occurs an inclining force in a lateral direction at a portion where the shaft 46A of the manipulation body 46 engages the bottom hole 48A of the manipulation knob 48. Wobble between the shaft 46A and the bottom hole 48A can be reduced, however, when they are so constructed as to fit and engage by a large margin of dimension.

If the manipulation knob 48 is depressed in a position closer to the peripheral contact 35 due to an inadvertent deviation from where the pushing manipulation is sought, in an attempt to turn on between the peripheral contacts 35 and 37, the shaft 46A of the manipulation body 46 tilts toward that direction, and causes the contact plate 47 on the lower surface of the flange 46B to come in contact with the peripheral contact 35 first at a corner of it corresponding to the contact 35. However, the flange 46B, as it is formed into an external configuration having a generally square shape, shifts along a side of the bottom surface contiguous to the corner toward the midway point between the peripheral contacts 35 and 37, and rests in that position to eventually provide the peripheral contacts 35 and 37 with a state of electrically continuity.

There is an occasion in that another signal is transmitted externally through the terminals 39 and 40 for external connections, if the dome-like circular movable contact 45 make unintentional contact with the central contact 33, thus causing continuity between the central contact 33 and the outer contact 34, when the dome-like circular movable contact 45 deforms downward during the tilting manipulation. This signal can be disregarded by the microcomputer (not shown in the figure) and so on, so that it detects a direction of the tilting manipulation only with a continuity signal through an adjacent pair of the peripheral contacts.

Figure 6:
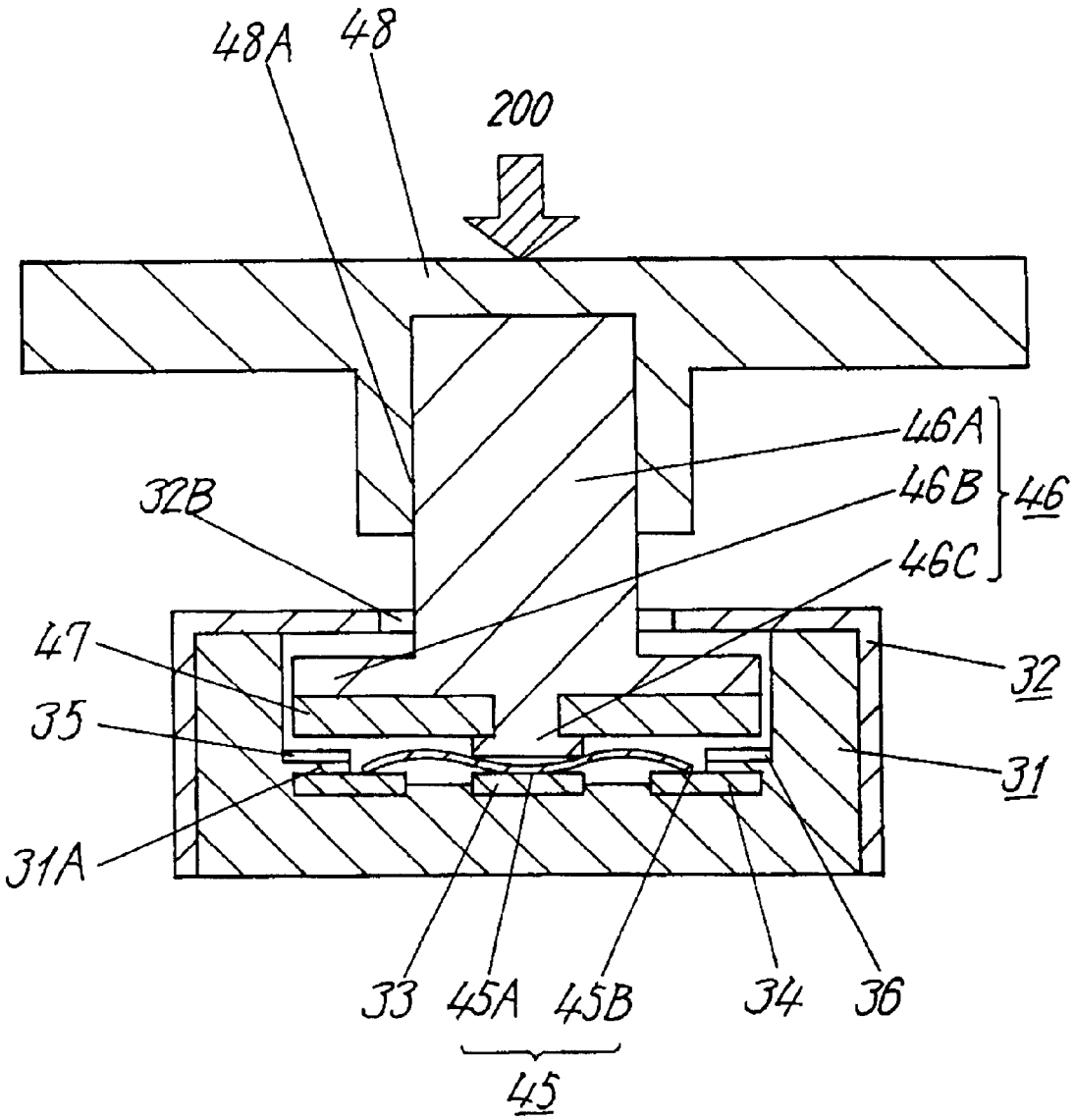
FIG. 6 is a sectional front view depicting the switch of FIG. 1 with the manipulation body in a position being depressed vertically downward.

Next, when a vertically downward depressing force is applied on the upper surface at the center of the manipulation knob 48, i.e. the shaft 46A of the manipulation body 46, as shown by an arrow 200 in a sectioned front view of FIG. 6, the manipulation body 46 moves vertically downward. This causes the projection 46C on the lower surface of the flange 46B to depress and deform the dome-like circular movable contact 45 downward, thereby yielding a tactile response. This, in turn, makes the underside surface of the top center portion 45A of the dome-like circular movable contact 45 come in contact with the central contact 33, and establishes electrical continuity between the central contact 33 and the outer contact 34 via the dome-like circular movable contact 45. The terminal 39 for external connection extending from the central contact 33 and another terminal 40 also for external connection extending from the outer contact 34 are thus provided with a state of electrically continuity.

An erroneous contact does not take place during this manipulation among the peripheral contacts 35, 36, 37 and 38, because a sufficient space is maintained between the contact plate 47 on the lower surface of the flange 46B and the peripheral contacts 35, 36, 37 and 38.

When the depressing force is removed from the manipulation knob 48, the dome-like circular movable contact 45 restores its original configuration by its own restoring force, and the manipulation body 46 is pushed back to the normal state shown in FIG. 1.

As described above, the multi-directional operating switch of this exemplary embodiment is intended to transmit predetermined signals corresponding to a tilting manipulation and a pushing manipulation. In an electronic device in which this switch is provided, therefore, this switch can readily perform such functions as, for example, selecting a certain item among what are displayed in a display window of the electronic device by moving a cursor or the like in the display with a signal obtained by a tilting manipulation, and entering the selected item with a signal obtained by a pushing manipulation.

Furthermore, the multi directional operating switch of this exemplary embodiment has the structure capable of obtaining a tactile response using only the single dome-like circular movable contact 45 disposed in the case 31, when turning an adjacent pair of the peripheral contacts into a conductive state by tilting the shaft 46A of the manipulation body 46, and also when gaining electrical continuity between the central contact 33 and the outer contact 34 by depressing the shaft 46A of the manipulation body 46 vertically downward. Accordingly, this structure can reduce the number of constituent components, and results in a small and thin multi-directional operating switch capable of making a reliable and stable switching function while also attaining a superior manipulatory feeling and operability, at a low cost.

In the present exemplary embodiment, although what has been described is an example of the contact plate 47 being fixed to the lower surface of the flange 46B of the manipulation body 46, the contact plate 47 can be omitted, if the manipulation body 46 is fabricated of an electrically conductive material, and the switch contact space is covered by a cover formed of a rigid insulation material. In this case, the manipulation body can be made easily at even a lower cost. The structure of this example can provide a switch that additionally brings the outer contact 34 in electrical continuity with the adjacent pair of peripheral contacts.

Figure 7:
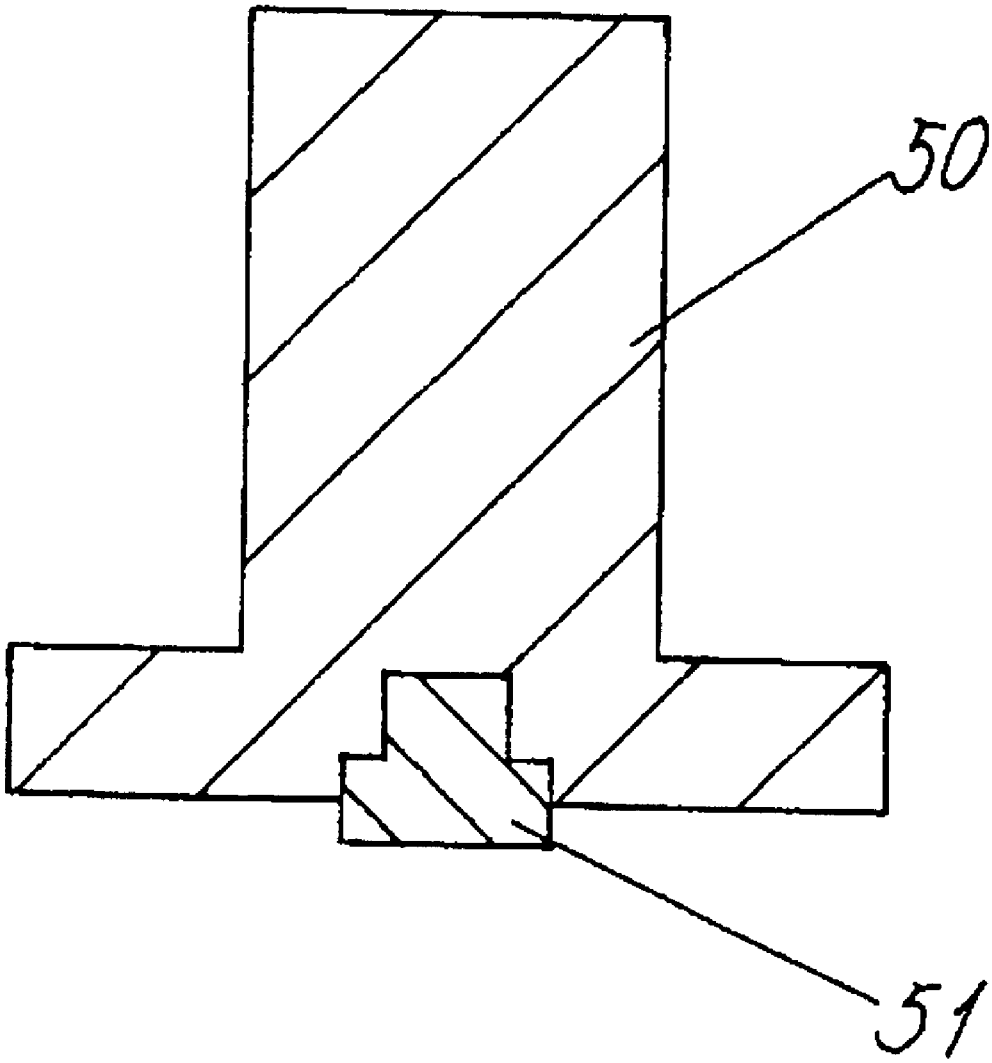
FIG. 7 is a sectional front view depicting another exemplary manipulation body of the switch of FIG. 1.

In the above described structure, an isolated condition can be maintained between a group of switching elements consisting of the adjacent pair of peripheral contacts and another group of switching elements consisting of the central contact and the outer contact, if a rivet 51 or the like, made of an insulation material, is attached to a lower end of a flange 50, made of an electrically conductive material, as shown in FIG. 7. With the adoption of this structure, a switch having a desired manipulatory feeling can be easily manufactured by simply selecting and mounting a rivet 51 of certain shape, without requiring an alteration of the other components.

Moreover, although what has been described above is an example wherein both the flange of the manipulation body and the opening in the case are generally square in shape, this is not restrictive, and they can be of any configuration including a quadrangle. By adopting a rectangular shape for both components, there can be realized easily a multi-direction operating switch that differentiates tilting angles between directions intersecting with each other.

In the above exemplary embodiment, although what has been described in detail is an example where the peripheral contacts are disposed at each corner of the generally square opening in the case, a pair of the peripheral contacts may be disposed at each side of the opening, so as to provide electrical continuity between them. This arrangement can completely isolate each group of circuits connected to the contacts located at each side of tilting direction from the other groups. Alternatively, a state of electrical continuity can be established between one of the peripheral contacts and the outer contact via an electrically conductive flange, if the manipulation body is constructed of an electrically conductive material and the peripheral contacts are disposed one at- each side of the opening.

Second Exemplary Embodiment

Figure 8:
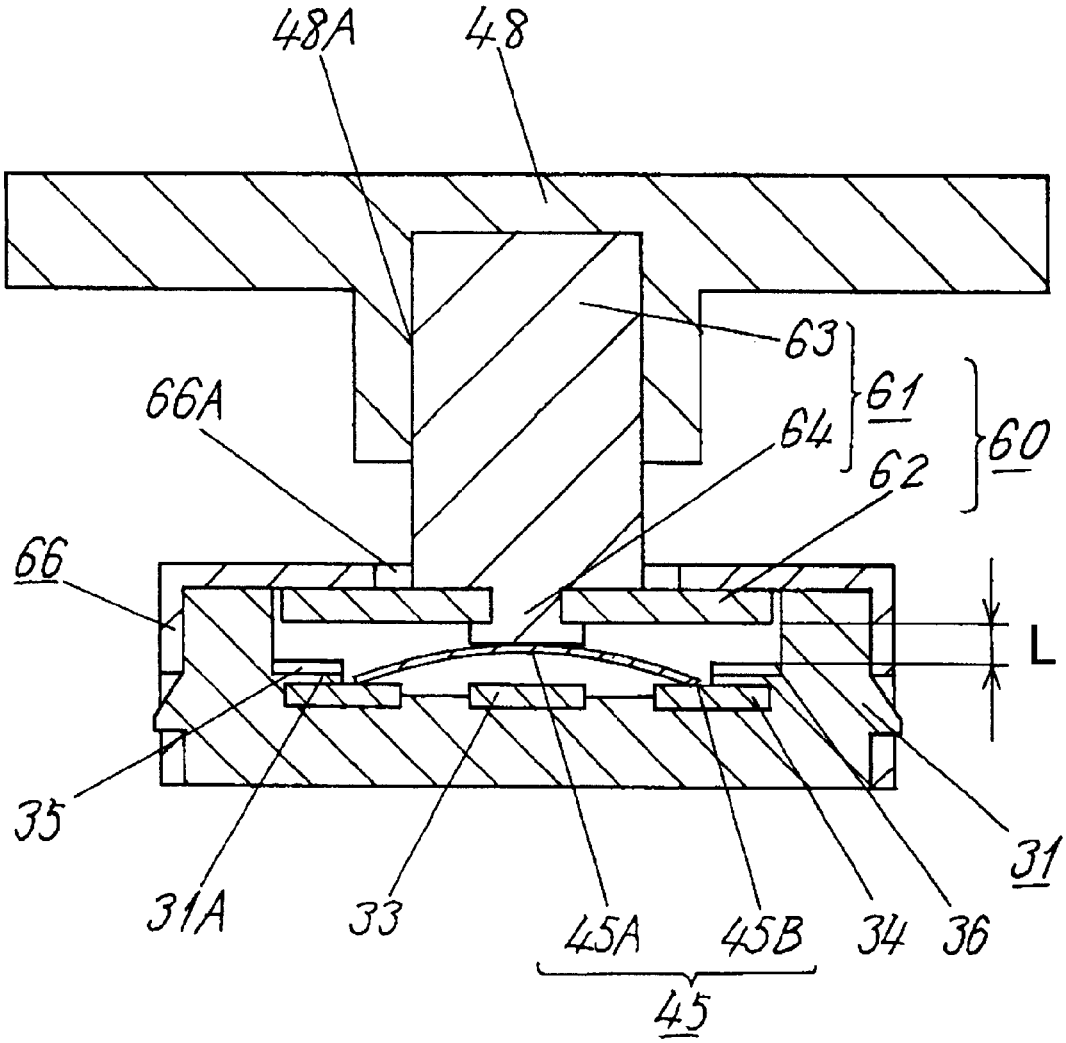
FIG. 8 is a sectional front view depicting a multi-directional operating switch of a second exemplary embodiment of this invention.

As shown in FIG. 8, a multi-directional operating switch of a second exemplary embodiment of the present invention differs from that of the first exemplary embodiment with respect to the structure of a manipulation body 60 and a cover 66.

The manipulation body 60 is composed of a shaft body 61 made of a rigid insulation material having an electrically conductive flange 62 having a generally square shape and made of a resilient metal plate secured to a lower end portion thereof. The shaft body 61 is such that an upper portion serves as a shaft 63, and a lower end portion protruding below the flange 62 serves as a projection 64.

The manipulation body 60 is disposed so that the projection 64 on a lower surface of the flange 62 rests in contact with a top center portion 45A of the dome-like circular movable contact 45, so as to receive a thrusting force of the dome-like circular movable contact 45 in an upward direction, similar to the first exemplary embodiment. The flange 62 is housed in a case 31 in such a manner that an upper surface of the flange 62 stays in contact with a lower surface of the cover 66 by the thrusting force, and the shaft 63 protrudes upwardly from a central through hole 66A in the cover 66.

In other words, this manipulation body 60 is also movable in response to a vertical manipulation as well as a tilting manipulation of the shaft 63, while being restricted from turning with respect to the case 31, similar to the first exemplary embodiment.

Since the cover 66, covering an opening in the case 31, is formed of a rigid insulation material, it is capable of preventing external electrostatic noise and so on from entering into a switching circuit.

A description of constituent components other than the manipulation body 60 and the cover 66 will not be repeated, as they are identical to those of the first exemplary embodiment.

Figure 9:
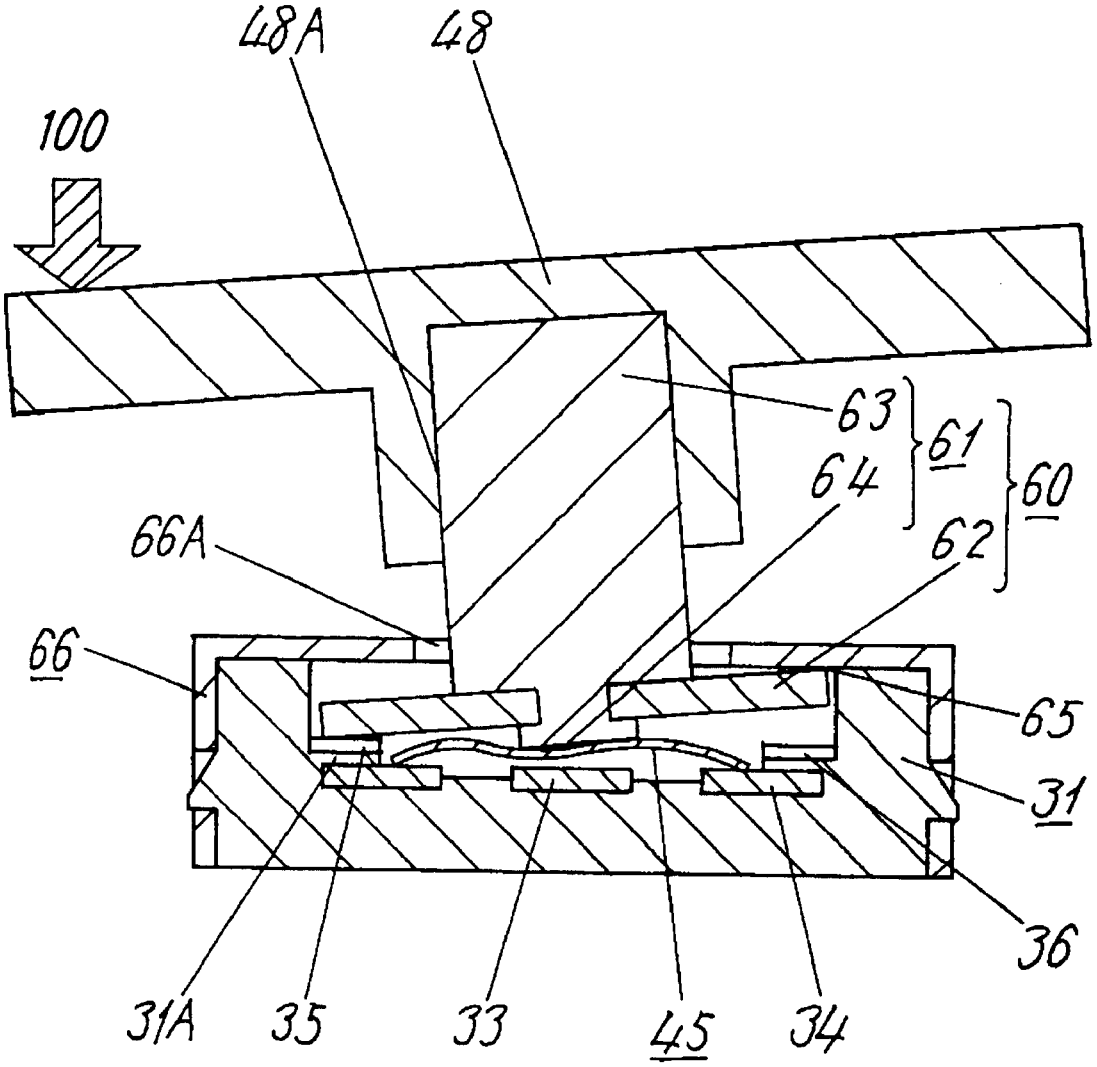
FIG. 9 is a sectional front view depicting the switch of FIG. 8 in a state where a flange is in contact with peripheral contacts during a tilting manipulation.

Operation of the multi-directional operating switch as constructed above will be described next. As shown in FIG. 9, when a manipulation knob 48 attached to an upper part of the shaft 63 is depressed at a position between any adjacent pair of peripheral contacts disposed on a bottom surface of the case 31, between the contacts 35 and 37 for instance, as shown by arrow 100, the manipulation body 60 tilts about a fulcrum at an upper edge 65 of the flange 62 of a side opposite the position where the depressing force is applied. This causes the projection 64, an integral part of the shaft 63, to depress and deform the dome-like circular movable contact 45, thereby yielding a tactile response, while also causing a lower surface of the electrically conductive flange 62 to contact with the peripheral contacts 35 and 37 at the same time.

This establishes a state of electrical continuity between the peripheral contacts 35 and 37 through the electrically conductive flange 62, i.e. an ON state between them, thereby providing an electrical continuity between terminals 41 and 43 for external connections.

The multi-directional operating switch of this exemplary embodiment is provided with a space (denoted by "L" in FIG. 8) between the lower surface of the electrically conductive flange 62 and upper surfaces of the peripheral contacts 35, 36, 37 and 38. This space is set so that the electrically conductive flange 62 comes in contact with the peripheral contacts 35 and 37 before the dome-like circular movable contact 45 comes in contact with a central contact 33, after the dome-like circular movable contact 45 yields a tactile response when being deformed downward during the tilting manipulation of the manipulation body 60.

Figure 10:
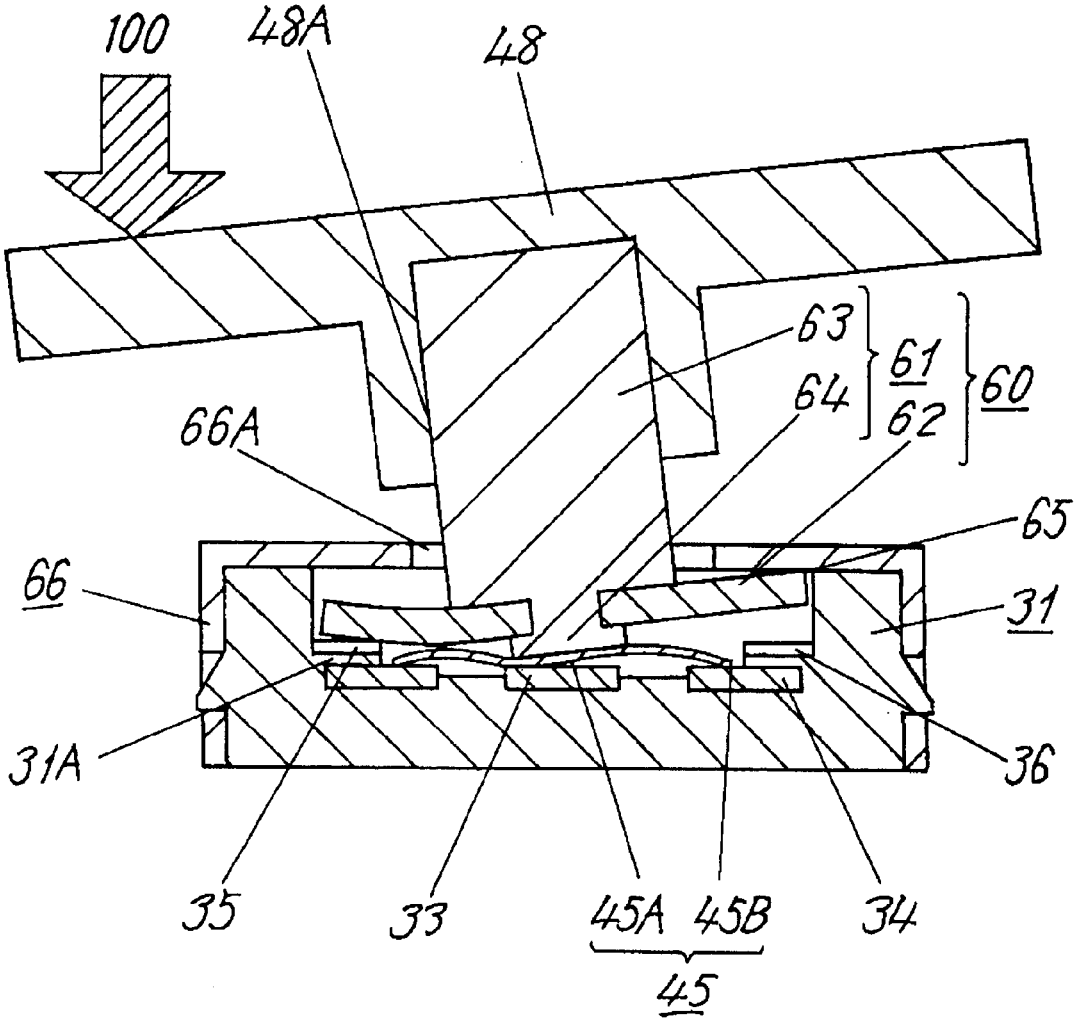
FIG. 10 is a sectional front view depicting the switch of FIG. 8 in a state where a shaft of a manipulation body is tilted to a full extent in the tilting manipulation.

As shown in FIG. 10, when the tilting force is increased thereafter, the dome-like circular movable contact 45 is further depressed downward, as the flange 62 deforms. Consequently, an underside surface of the dome-like circular movable contact 45 comes in contact with the central contact 33, to establish a state of electrical continuity between the central contact 33 and the outer contact 34.

When the depressing force placed on the manipulation knob 48 is subsequently removed, the manipulation body 60 is pushed upward by resilient restoring forces of the flange 62 and the dome-like circular movable contact 45. As shown in FIG. 8, the lower surface of the flange 62 separates from the peripheral contacts 35 and 37, and the shaft 63 resumes a normal state, i.e. an upright neutral position.

When the manipulation knob 48 is depressed in the like manner at another position between any adjacent pair of the peripheral contacts, the manipulation body 60 tilts toward that direction, thereby making the corresponding peripheral switch contacts into a state of continuity. Accordingly, the switch functions in the like manner as the first exemplary embodiment, in that it provides electrical continuity between corresponding terminals, allows a microcomputer to detect a signal delivered through the terminals, and thereby the microcomputer is able to determine a direction of the tilting manipulation of the manipulation body 60.

When a vertically downward depressing force is applied on the upper surface at the center of the manipulation knob 48, i.e. the shaft 63 of the manipulation body 60, the projection 64 depresses and deforms the dome-like circular movable contact 45 downward, as the manipulation body 60 shifts downwardly, thereby yielding a tactile response, while also causing the dome-like circular movable contact 45 to contact with the central contact 33. This establishes a state of electrical continuity between the central contact 33 and the outer contact 34. When the depressing force is removed, the dome-like circular movable contact 45 restores its original shape by its own restoring force, and pushes the manipulation body 60 back into the normal state shown in FIG. 8. These operations are same as what has been described in the first exemplary embodiment.

As described above, the multi-directional operating switch of this exemplary embodiment is operable for electrically making and breaking continuity between the central contact 33 and the outer contact 34 via the dome-like circular movable contact 45 after turning any combination of two contacts among the peripheral contacts 35, 36, 37 and 38 into an ON state by a tilting manipulation of the shaft 63, in addition to the same switching functions provided by the first exemplary embodiment. Therefore, this multi-directional operating switch is adaptable for such an application, wherein a cursor or the like shown in a display window of a device equipped with this switch is moved to a desired direction at a first speed using a switching signal obtained through the peripheral contacts 35, 36, 37 and 38 by a tilting manipulation, and the moving speed shifted to an even faster second speed with another switching signal through the central contact 33 and the outer contact 34 by depressing the shaft 63 further into the same tilting direction.

In addition, when the switch is used in a two step operation in a manner as described above, a microcomputer (not show) is able to detect a difference in time of electrical continuity between the switching signal transferred through two contacts among the peripheral contacts 35, 36, 37 and 38 and the other switching signal transferred through the center contact 33 and the outer contact 34. Accordingly, the cursor and so on can be scrolled at a speed corresponding to a tilting speed, force, etc. applied to the shaft 63, as they are calculated from the detected results.

What has been described above is an example wherein the shaft 63 of the manipulation body 60, when tilted, is capable of turning any adjacent pair of the peripheral switch contacts into the ON state after making the dome-like circular movable contact 45 deform and yield a tactile response, followed thereafter by causing the center contact 33 and the outer contact 34 into the state of continuity. However, the switch may be altered into such an operational order that a tilting manipulation of the shaft 63 connects the electrically conductive flange 62 with an adjacent pair of the peripheral contacts, making them first into the state of continuity, and a further tilting force given thereafter to the shaft 63 depresses the dome-like circular movable contact 45 downward by deforming the flange 62, thereby making the center contact 33 and the outer contact 34 into the state of continuity while downwardly deforming the dome-like circular movable contact 45 to yield the tactile response.

Altering the switch to provide the foregoing operation can produce the tactile response only after the peripheral switch contacts turn into the state of continuity during the tilting manipulation of the shaft 63. However, an operator can get a feel of clicking while making a manipulation of the peripheral switch contacts, since the moment when the peripheral switch contacts turn into the state of continuity and another moment of yielding the tactile response are very close to each other in actual use.

Even with the multi-directional operating switch constructed as above, the operator is able to know positively a validness of his manipulation by the feel of clicking when making a tilting manipulation, if the microcomputer (not shown) employed for determining the tilting direction is arranged to carry out a process in much a way that it determines a signal from the peripheral switch contacts as being a valid one, only when both of a signal from the peripheral switch contacts and a signal from the center contact 33 and the outer contact 34 are delivered within a predetermined period of time.

As described above, the cover 66 covering the opening in the case 31 is constructed of a rigid insulation material. This multi-directional operating switch is thus capable of preventing external electrostatic noise and so on from entering a space of the switch contacts, and thereby the switch can be used reliably in an application involving very small voltages and currents.

In addition, this multi-directional operating switch provides an effect of avoiding damage to the contacts, etc. since the flange 62 is constructed of a resilient body and capable of absorbing an excessive manipulatory force applied to the shaft 63.

Third Exemplary Embodiment

Figure 11:
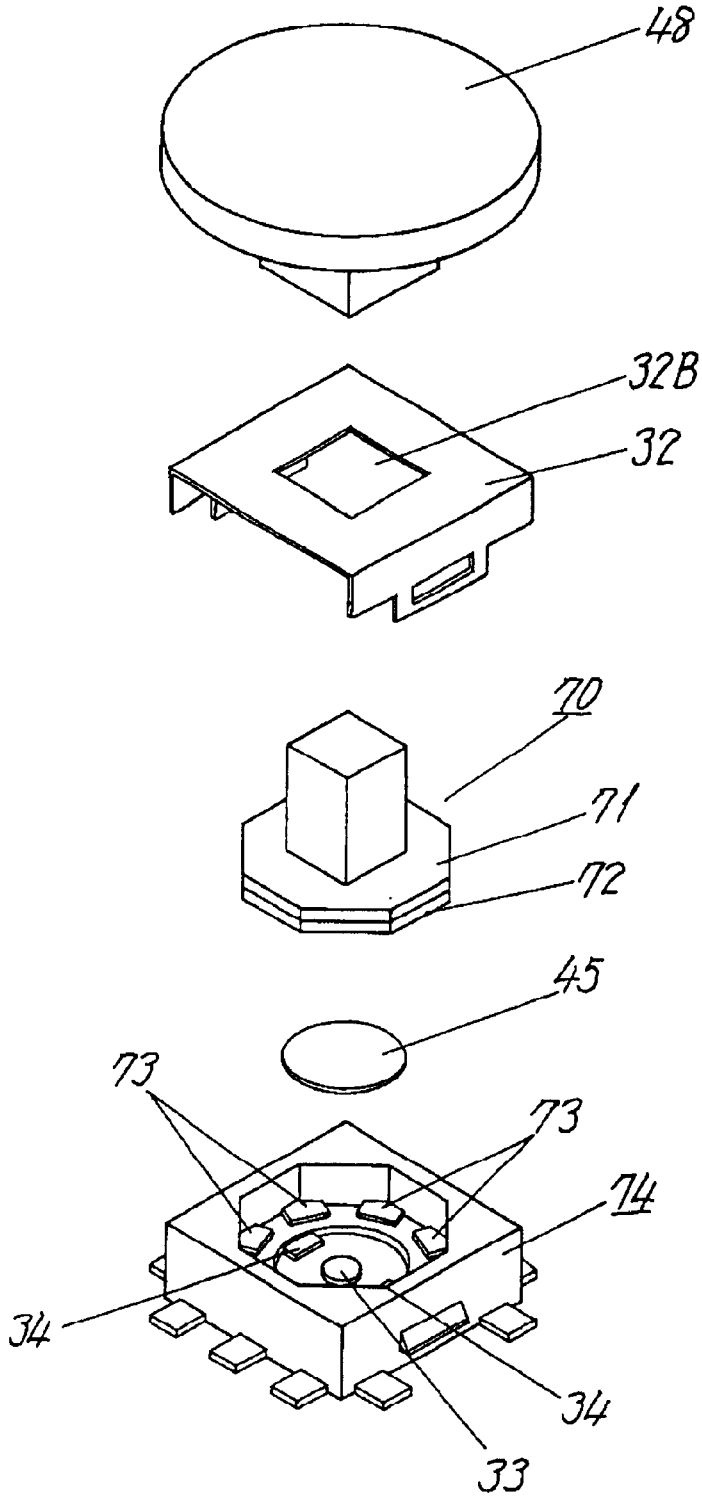
FIG. 11 is an exploded perspective view depicting a multi-directional operating switch of a third exemplary embodiment of this invention.

Referring now to FIG. 11, a multi-directional operating switch of a third exemplary embodiment of the present invention employs an opening of a case and a flange of a manipulating body having different shapes as compared to that of the above-described first exemplary embodiment.

In other words, a flange 71 of a manipulation body 70 constructed of an insulation material has generally an octagonal shape, for example, in the multi-directional operating switch of this exemplary embodiment, as shown in the FIG. 11. A contact plate 72 fabricated of an electrically conductive material into a shape substantially similar to that of flange 71 is secured to the flange 71 by the outsert molding in such a manner as to cover an entire lower surface, except for a lower projection (not shown in the figure) provided on the lower surface in the center of the flange 71.

The flange 71 is housed in a case 74 having a top opening formed into a generally octagonal shape of a similar configuration in plan view and having a size slightly larger than the flange 71. The case 74 is provided with peripheral contacts 73 on an inner bottom surface, one at each corner of the opening, and a respective terminal protrudes outwardly from each of the peripheral contacts 73. Further description will not be repeated, since the manner in which the flange 71 is housed and the other constituent components are identical to those of the first exemplary embodiment.

The description pertaining to the operation of the switch will also not be repeated, as it operates in a similar manner to that of the first exemplary embodiment.

This multi-directional operating switch is adaptable to a tilting manipulation in eight directions, since it is provided with a combination of the flange 71 and the opening of the case 74, both being generally octagonal in shape, and eight peripheral contacts 73 positioned on the inner bottom surface at each corner of the opening in the case 74 at an equal distance and an equal angle from each other, it.

A multi-directional operating switch tiltable to a desired number of directions can also be obtained by arranging a combination of the flange of the manipulation body and the opening of the case having a polygonal shape, such as a pentagon, a hexagon, and the like according to the desired number of tilting directions, and disposing the peripheral contacts on the inner bottom surface at each corner of the opening.

Fourth Exemplary Embodiment

Figure 12:
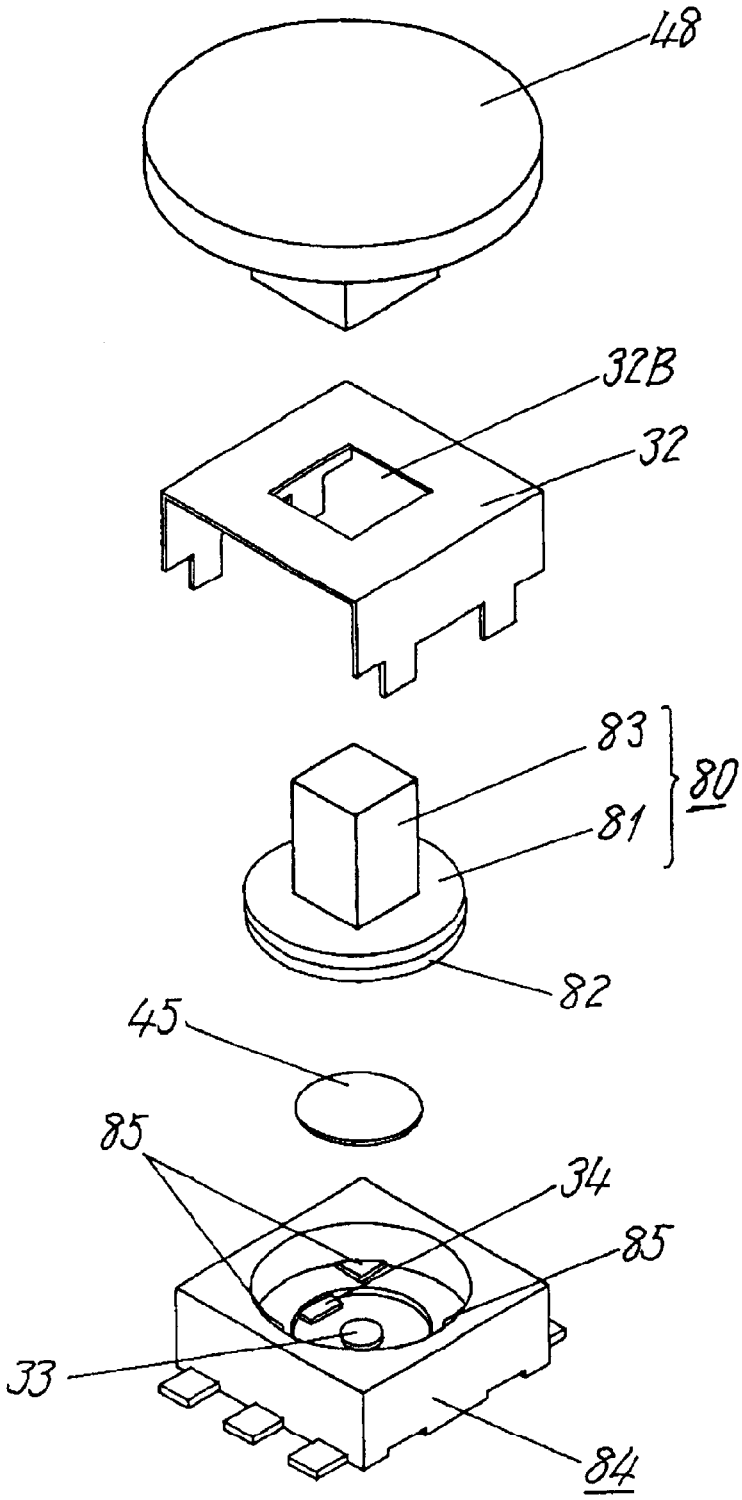
FIG. 12 is an exploded perspective view depicting a multi-directional operating switch of a fourth exemplary embodiment of this invention.
Figure 13:
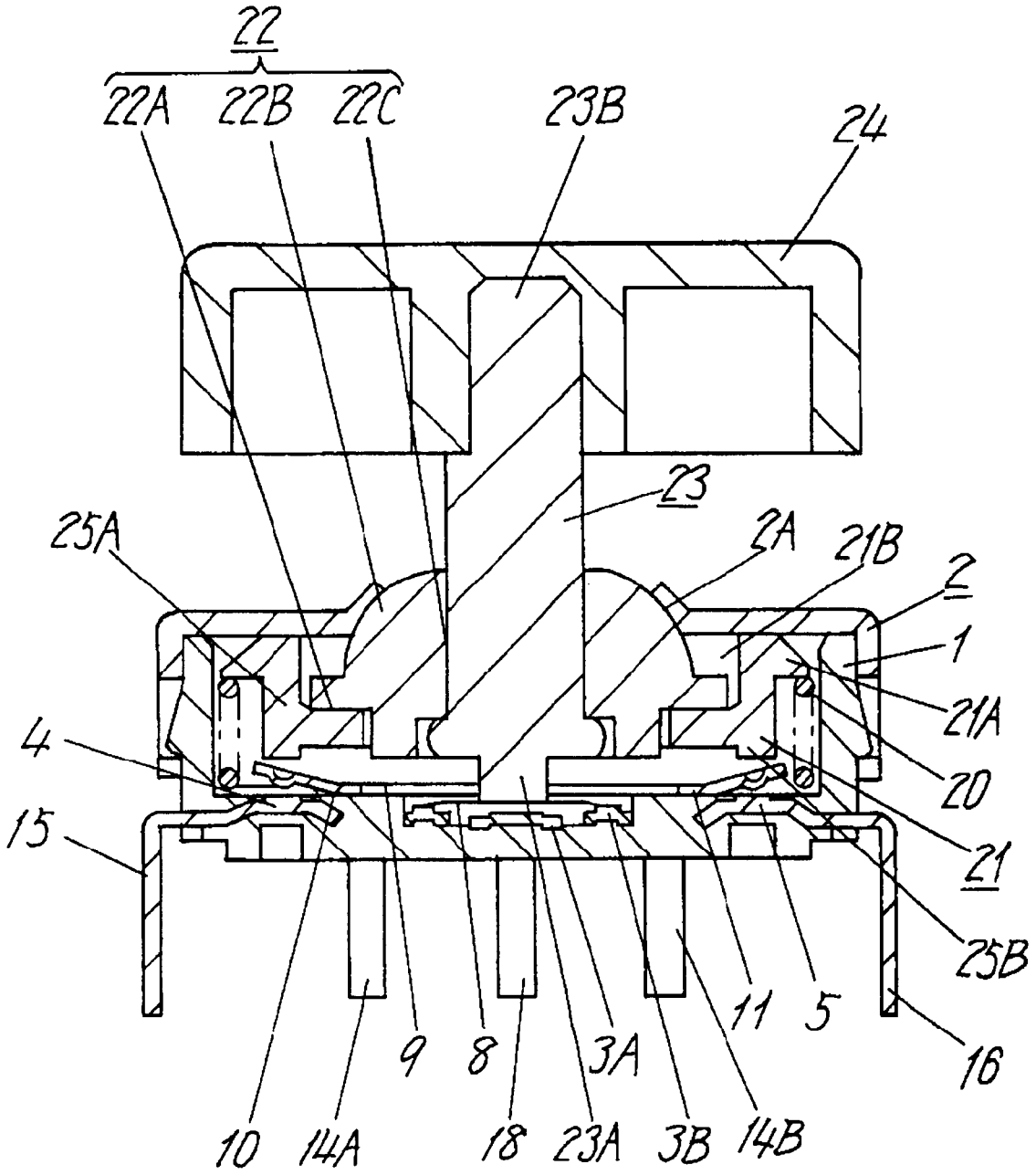
FIG. 13 PRIOR ART
FIG. 13 is a sectional side view depicting a multi-directional operating switch of the prior art.
Figure 14:
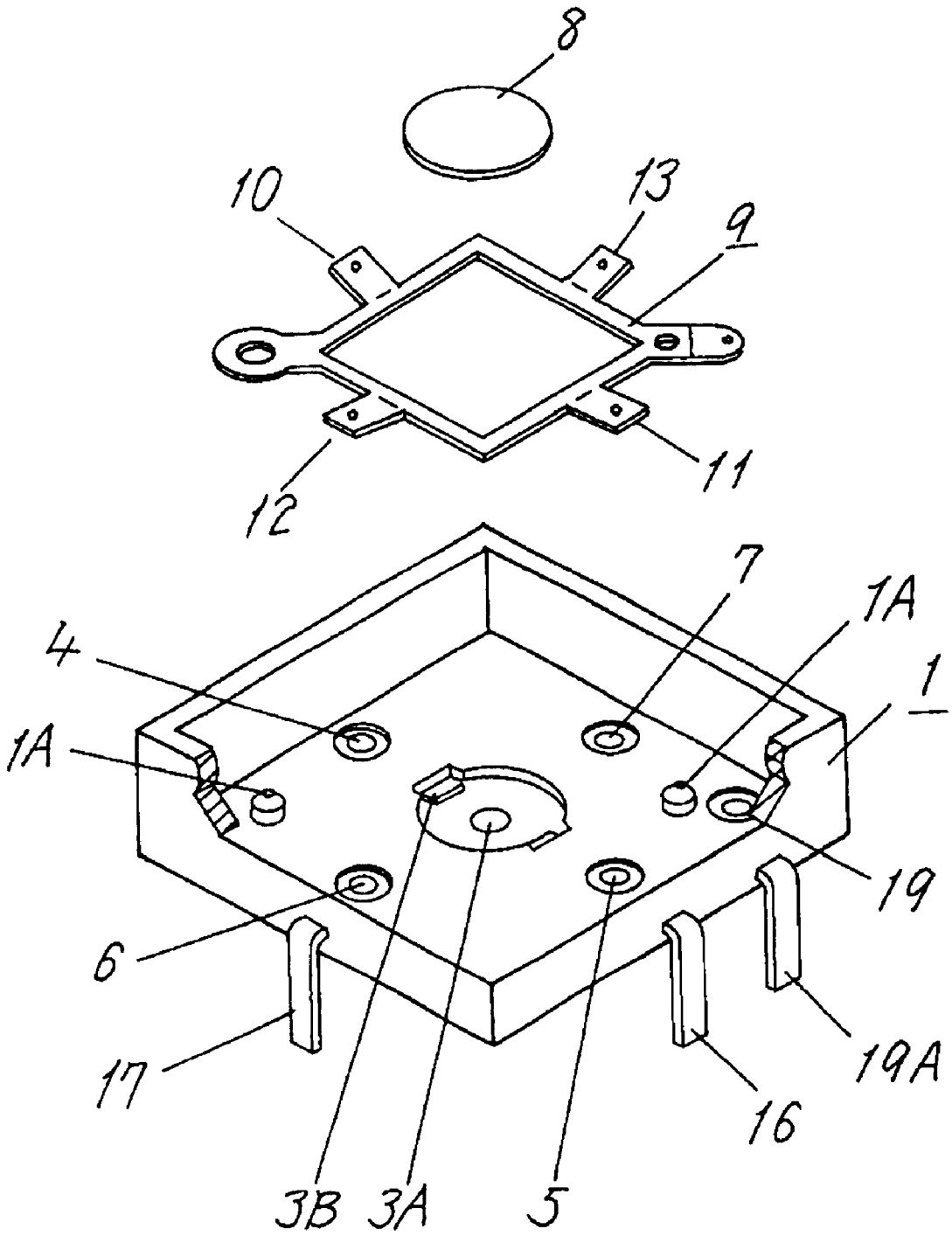
FIG. 14 PRIOR ART
FIG. 14 is an exploded perspective view depicting the switch of FIG. 13 with the case partially cut away.
Figure 15:
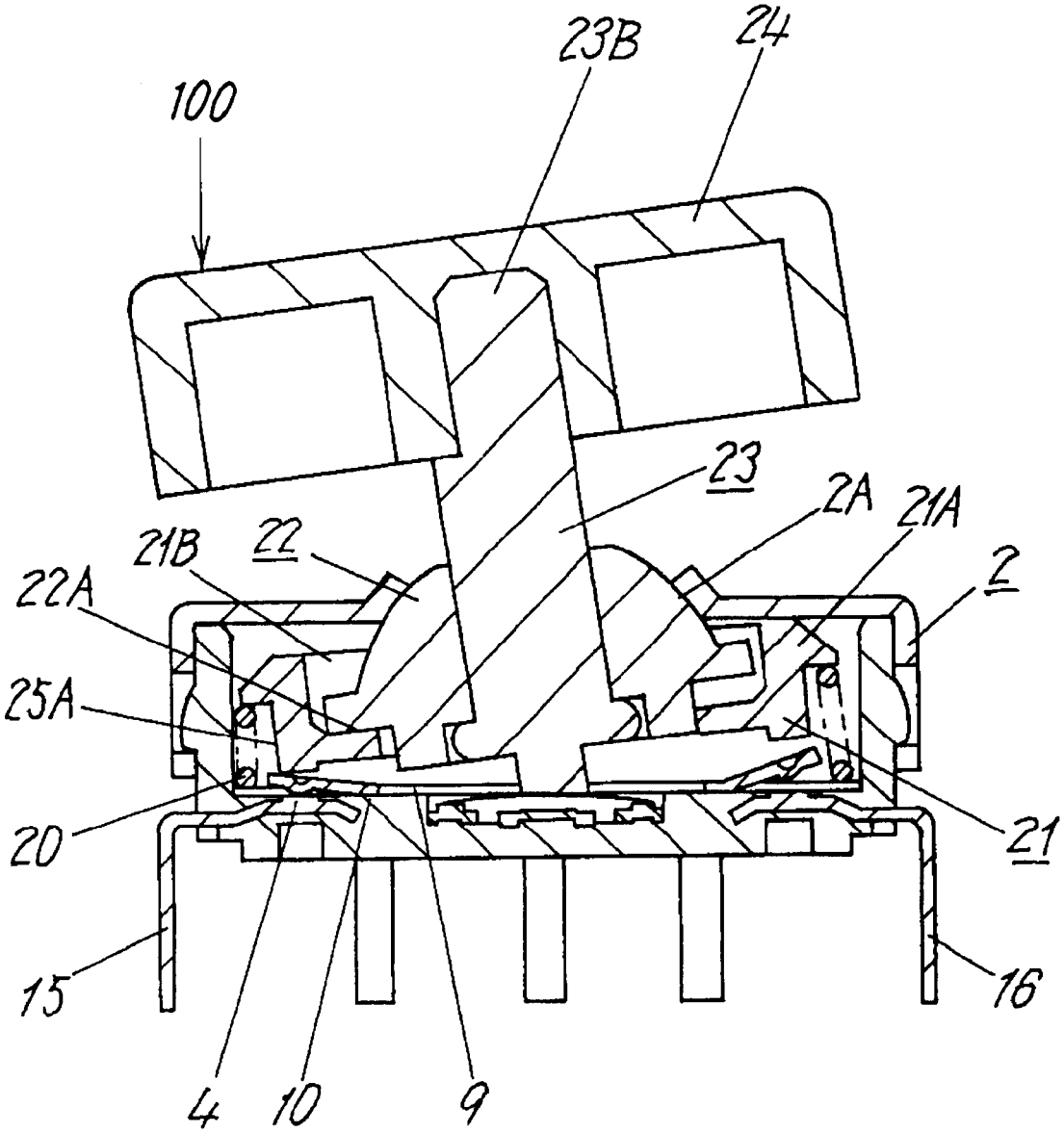
FIG. 15 PRIOR ART
FIG. 15 is a sectional front view depicting the switch of FIG. 13 with the manipulation body in a tilted position.
Figure 16:
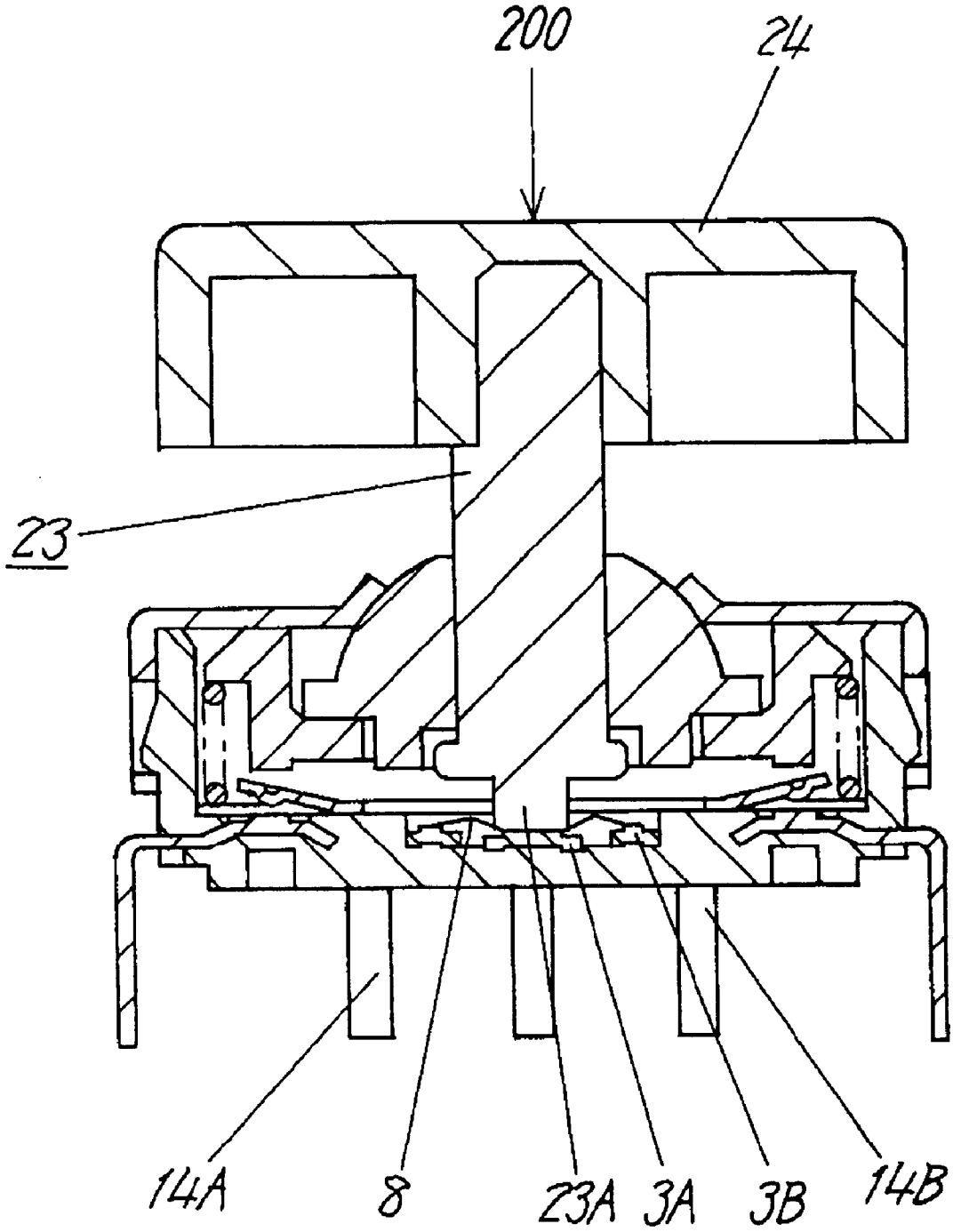
FIG. 16 PRIOR ART
FIG. 16 is a sectional front view depicting the switch of FIG. 13 with the manipulation body in a position being depressed vertically downward.

Referring now to FIG. 12, a multi-directional operating switch of a fourth exemplary embodiment of the present invention employs a circular shape for an opening of a case and a flange of a manipulation body, as opposed to those of the above described first and third exemplary embodiments.

As shown in FIG. 12, a contact plate 82 fabricated of an electrically conductive material into substantially the same shape as a flange 81 is mounted on a flange 81 having a circular shape, for example, of a manipulation body 80 constructed of an insulation material by the outsert molding to make a lower surface of the flange 81 electrically conductive, in a manner similar to the first and third exemplary embodiments. A description of further details will therefore not be repeated.

A shaft 83 of the manipulation body 80 formed into a quadrangular prism shape is inserted through a central through hole 32B of a cover 32, and the engaged portion between them provides a turn restraining means of the manipulation body 80.

Moreover, the flange 81 of the manipulation body 80 is housed in the case 84 having the opening of a circular shape as viewed from the above. Peripheral contacts 85 are disposed on an inner bottom surface of the opening in the case 84 in a corresponding manner to an orientation of corners of the shaft 83 so as to be equidistant and equiangular in the four directions with respect to the center of the opening of the case 84. Terminals for external connections of the contacts protrude outwardly from the case 84.

Further description will not be repeated, since a manner in which the flange 81 is housed in the opening of the case 84 and other constituent components are identical to those of the first exemplary embodiment. Description as to how the switch operates is also omitted, as it is the same as in the case of the first exemplary embodiment. The multi-directional operating switch of this exemplary embodiment is capable of preventing the manipulation body 80, when being manipulated, from turning within the case 84 by the turn restraining means.

The turn restraining means may be composed of a combination of other shapes such as a polygonal shape or an elliptical shape, besides the foregoing configuration. In a switch provided with a combination of components with polygonal shape having many corners such as octagon, in particular, the manipulation body becomes capable of being moved continuously in a manner that a tip of the shaft shifts along a circle while the shaft of the manipulation body is kept tilted, and thereby the peripheral contacts can be switched smoothly and consecutively along a given circular direction.

Fifth Exemplary Embodiment

The present exemplary embodiment relates to a multi-directional operating device using a multi-directional operating switch of this invention. A mobile communications device will be described as an example. In the mobile communications device such as a portable telephone, a radio pager, and the like, equipped with a multi-directional operating switch of this invention, for instance, an operator is able to perform a tilting manipulation of a shaft to move a cursor, to scroll and search a menu, characters, etc., shown in a display window such as a liquid crystal screen, make a pushing manipulation of the shaft to enter the menu, and execute the selected menu, i.e. transmission of a signal, by making another pushing manipulation.

Sixth Exemplary Embodiment

The present exemplary embodiment relates to a multi-directional operating device using a multi-directional operating switch of this invention. Various kinds of remote controllers and audio equipment are examples of a device as described below. In a remote controller and audio equipment equipped with a multi-directional operating switch of this invention, an operator can turn a power supply on and off, or select playback and stop one after another for example, by repeating a pushing manipulation of a shaft. The operator can execute a number of prearranged commands, such as selection of a station or music, raise and lower sound volume, fast-forwarding and rewinding, and so on, by making tilting manipulations of the shaft, if the commands are appropriately combined and allocated to each of a forward-to-backward direction and a right-to-left direction in tilting manipulation of the shaft. In addition, the operator can also switch the commands allocated to the multi-directional operating device by making a pushing manipulation of the shaft.

Seventh Exemplary Embodiment

The present exemplary embodiment relates to a multi-directional operating device using a multi-directional operating switch of this invention. A game machine and a car navigation system will be taken as an example. In the game machine or the car navigation system equipped with a multi-directional operating switch of this invention, an operator performs a tilting manipulation of a shaft to move a character or a map in a display window according to a certain manner of tilting the shaft, and executes a prearranged commend such as changing a magnification of the map, jumping the character, and so on by a pushing manipulation of the shaft.

Eighth Exemplary Embodiment

The present exemplary embodiment relates to a multi-directional operating device using a multi-directional operating switch of this invention, and an electronic camera will be taken as an example. In the electronic camera equipped with a multi-directional operating switch of this invention, an operator performs a tilting manipulation of a shaft to select a shutter speed, a lens opening, and so on, and sets the selected values by a subsequent pushing manipulation of the shaft. Furthermore, the operator can set a position of an object to be focused in a view finder by making another tilting manipulation of the shaft, bring the focus on the subject by pushing the shaft, and release a shutter by pushing the shaft again within a predetermined period of time.

Ninth Exemplary Embodiment

The present exemplary embodiment relates to a multi-directional operating device using a multi-directional operating switch of this invention, and a computer will be taken as an example. In a computer equipped with a multi-directional operating switch of this invention, an operator can enter and execute a menu by making a pushing manipulation of a shaft, after moving a cursor in a display window and selecting the menu by a tilting manipulation of the shaft.

As has been described, the present invention can provide the multi-directional operating switch having such advantageous features as using a small number of constituent components, small outer dimensions and thickness, a low cost, as well as performing a reliable and steady switching operation with a positive tactile response even when making the switching operation by tilting the manipulation body sideways.

In addition, the multi-directional operating device using the multi-directional operating switch of this invention realizes an effect of achieving congregation and simplification of a variety of operating functions at the same time with reduction in size, thickness and weight.

What is claimed is:

1. A multi-directional operating switch comprising:

a case having an opening in an upper surface thereof, said case including a central contact, an outer contact disposed in a position spaced away from said central contact, and a plurality of peripheral contacts, all disposed on a bottom surface of said opening;

a dome-like circular movable contact having a center portion disposed above said central contact, and a lower peripheral rim of said dome-like circular movable contact resting in contact with said outer contact;

a cover having with a through hole in a location concentric to said dome-like circular movable contact; and a manipulation body comprising a shaft protruding said through hole, a flange having electrical conductivity on at least a lower surface thereof, said flange disposed at a lower end of said shaft, and a projection extending from the lower surface of said flange, said shaft being both tiltable and movable in a vertical direction, and said manipulation body biased upwardly by said dome-like circular movable contact in a manner that at least a peripheral surface of said flange is in contact with a lower surface of said cover, wherein said projection on said flange depresses and deforms said dome-like circular movable contact to establish a first electrical continuity between said central contact and said outer contact, when said shaft being moved in a downward direction, and the lower surface of said flange establishes a second electrical continuity between adjacent two of said plurality of peripheral contacts responsive to said shaft being moved in a tilting direction.

2. The multi-directional operating switch according to claim 1, wherein said opening in said case and said flange of said manipulation body are substantially similar in shape.

3. The multi-directional operating switch according to claim 2, wherein said opening in said case has a shape of one of a rectangle, a square, a pentagon, a hexagon, an octagon, and a circle.

4. The multi-directional operating switch according to claim 1, wherein said plurality of peripheral contacts are disposed on said bottom surface at respective corners of said opening in said case.

5. The multi-directional operating switch according to claim 1, wherein said plurality of peripheral contacts are disposed on said bottom surface at respective sides of said opening in said case.

6. The multi-directional operating switch according to claim 1, wherein said opening in said case is substantially circular in shape, said plurality of peripheral contacts are disposed at an equal distance from a center of said case, and at substantially equal angular positions, said flange of said manipulation body is formed into a circular shape having a size smaller than a size of said opening, and a turn restricting means for said manipulation body is provided in a portion where said shaft of said manipulation body engages said through hole in said cover.

7. The multi-directional operating switch according to claim 6, wherein said turn restricting means comprises said through hole having a non-circular shape in said cover and said shaft of said manipulation body having a shape substantially similar to that of said through hole.

8. The multi-directional operating switch according to claim 6, wherein said through hole has a square shape and said shaft has a quadrangular prism shape.

9. The multi-directional operating switch according to claim 1, wherein at least said projection provided on the lower surface of said flange of said manipulation body is composed of an insulation material.

10. The multi-directional operating switch according to claim 1, wherein said cover is made of a rigid insulation material, said manipulation body is made of a rigid insulation material and integrally formed with said shaft and said projection on the lower surface of said flange, and an electrically conductive contact plate is fixed to the lower surface of said flange.

11. The multi-directional operating switch according to claim 1, wherein said cover is made of a rigid insulation material, said shaft and said flange of said manipulation body are integrally formed of an electrically conductive material, and said projection is made of an insulation material fixed on the lower surface at a center of said flange.

12. The multi-directional operating switch according to claim 1, wherein said manipulation body is provided with the flange made of an electrically conductive material having resiliency, said multi-directional operating switch establishes a first electrical continuity between an adjacent pair of said plurality of peripheral contacts, and a further electrical continuity thereafter between said central contact and said outer contact, as said projection under said flange subsequently depresses said dome-like circular movable contact after said flange on said manipulation body deforms resiliently, when said shaft is tilted.

13. A multi-directional operating device provided with the multi-directional operating switch of claim 1, wherein said device is for:

detecting an ON state between an adjacent pair of said plurality of peripheral contacts responsive to said shaft of said manipulation body being tilted, for selecting an item among a plurality of items; and detecting an ON state between said central contact and said outer contact responsive to said shaft being depressed vertically downward, for entering said item selected among said plurality of items.

14. The multi-directional operating device according to claim 13, wherein said device detects sequential switching signals transmitted from said central contact and said outer contact produced when said shaft is continuously depressed vertically for a plurality of times within a predetermined period of time, for executing a plurality of predetermined commands in a sequential order by said signals.

15. The multi-directional operating device according to claim 13, wherein said device executes a command pre-allocated to each of tilting directions of said shaft, when said shaft is tilted in directions opposite to each other with respect to a neutral position of said shaft.

16. The multi-directional operating device according to claim 13, wherein said device detects an ON state between said central contact and said outer contact when said shaft is depressed vertically downward, and switches a command pre-allocated to each of respective tilting directions of said shaft in a predetermined order.

17. A multi-directional operating device provided with the multi-directional operating switch of claim 1, wherein said device is for:

detecting an ON state between an adjacent pair of said plurality of peripheral contacts responsive to said shaft of said manipulation body being tilted, for selecting one of a plurality of signals whereto directions of a vector are pre-allocated, for moving a displayed object toward a direction of said vector corresponding to a selected signal; and detecting an ON state between said central contact and said outer contact responsive to said shaft being depressed vertically downward, for executing a command allocated in advance to said moved object.

18. The multi-directional operating device according to claim 17, wherein said device detects sequential switching signals transmitted from said central contact and said outer contact produced when said shaft is continuously depressed vertically for a plurality of times within a predetermined period of time, for executing a plurality of predetermined commands in a sequential order by said signals.

19. The multi-directional operating device according to claim 17, wherein said device executes a command pre-allocated to each of tilting directions of said shaft, when said shaft is tilted in directions opposite to each other with respect to a neutral position of said shaft.

20. The multi-directional operating device according to claim 17, wherein said device detects an ON state between said central contact and said outer contact when said shaft is depressed vertically downward, and switches a command pre-allocated to each of respective tilting directions of said shaft in a predetermined order.

21. The multi-directional operating switch according to claim 1, wherein said manipulation body is anti-rotatable within said case.

* * * * *